US010926131B2

(12) United States Patent
Yu et al.

(10) Patent No.: US 10,926,131 B2
(45) Date of Patent: Feb. 23, 2021

(54) ELLIPTICAL MACHINE

(71) Applicants: Chao-Chi Yu, Taichung (TW); Cheng-Ru Yu, Taichung (TW)

(72) Inventors: Chao-Chi Yu, Taichung (TW); Cheng-Ru Yu, Taichung (TW)

( * ) Notice: Subject to any disclaimer, the term of this patent is extended or adjusted under 35 U.S.C. 154(b) by 0 days.

(21) Appl. No.: 16/375,343

(22) Filed: Apr. 4, 2019

(65) Prior Publication Data

US 2020/0121982 A1 Apr. 23, 2020

(30) Foreign Application Priority Data

Oct. 18, 2018 (TW) ..... 107214077 U

(51) Int. Cl.
*A63B 22/06* (2006.01)
*A63B 22/00* (2006.01)
(Continued)

(52) U.S. Cl.
CPC ..... *A63B 22/0664* (2013.01); *A63B 21/159* (2013.01); *A63B 21/225* (2013.01);
(Continued)

(58) Field of Classification Search
CPC ..... A63B 21/00058; A63B 21/00069; A63B 21/00072; A63B 21/00076; A63B 21/15; A63B 21/159; A63B 21/22; A63B 21/225; A63B 21/4027; A63B 21/4033; A63B 21/4034; A63B 21/4035; A63B 21/4045; A63B 21/4047; A63B 22/0002; A63B 22/001; A63B 22/000466; A63B 22/0048; A63B 22/0056; A63B 22/06; A63B 22/0664; A63B 22/20; A63B 22/201; A63B 22/203; A63B 22/205; A63B 2022/0676; A63B 2022/206; A63B 23/035; A63B 23/03516; A63B 23/03533; A63B 23/03575; A63B 23/04; A63B 23/0405;
(Continued)

(56) References Cited

U.S. PATENT DOCUMENTS 5,593,372 A * 1/1997 Rodgers, Jr. ..... A63B 22/001 482/51
5,919,118 A * 7/1999 Stearns ..... A63B 22/001 482/51
(Continued)

*Primary Examiner* — Gary D Urbiel Goldner
(74) *Attorney, Agent, or Firm* — Egbert Law Offices, PLLC

(57) ABSTRACT

An elliptical machine has a base, an upright column fixed to the base, a transmission mechanism mounted on the base, and two link mechanisms respectively connected with opposing sides of the transmission mechanism. Each link mechanism includes a first link rod that is telescopic and connected with both the transmission mechanism and the base, and a second link rod having a pedal and connected with the first link rod such that the pedals of the two link mechanisms are respectively linked to the transmission mechanism through the first and second link rods. When a user uses each pedal, a total length of the corresponding first link rod is reciprocatingly and continuously changed, so that a top end of the first link rod makes a first circulatory movement along a first elliptical path, and the corresponding pedal synchronously makes a second circulatory movement along a second elliptical path.

10 Claims, 10 Drawing Sheets

(51) Int. Cl.
*A63B 21/00* (2006.01)
*A63B 21/22* (2006.01)

(52) U.S. Cl.
CPC ..... *A63B 21/4034* (2015.10); *A63B 22/001* (2013.01); *A63B 22/0056* (2013.01); *A63B 2022/0676* (2013.01)

(58) Field of Classification Search
CPC ..... A63B 23/0423; A63B 23/0482; A63B 23/0494; A63B 23/12; A63B 23/1209; A63B 23/1245; A63B 23/1263; A63B 23/1281; A63B 69/0028; A63B 2225/09; A63B 2225/093
See application file for complete search history.

(56) References Cited

U.S. PATENT DOCUMENTS 6,196,948 B1 * 3/2001 Stearns ..... A63B 22/001 482/51
6,361,476 B1 * 3/2002 Eschenbach ..... A63B 22/001 482/51
6,390,953 B1 * 5/2002 Maresh ..... A63B 22/0015 482/51
7,435,204 B2 * 10/2008 Wu ..... A63B 22/001 482/51
7,871,356 B2 * 1/2011 Smith ..... A63B 22/0015 482/52
8,257,230 B2 * 9/2012 Chen ..... A63B 22/001 482/52
9,259,610 B2 * 2/2016 Huang ..... A63B 21/225
10,702,736 B2 * 7/2020 Weston ..... A63B 22/0023
2001/0001305 A1 * 5/2001 Stearns ..... A63B 22/0664 482/66
2002/0165066 A1 * 11/2002 Stearns ..... A63B 22/0007 482/52
2003/0045401 A1 * 3/2003 Watterson ..... A63B 22/001 482/51
2005/0049117 A1 * 3/2005 Rodgers, Jr. ..... A63B 22/0017 482/52
2007/0117683 A1 * 5/2007 Ercanbrack ..... A63B 22/001 482/52
2008/0139366 A1 * 6/2008 Born ..... A63B 22/0664 482/52
2008/0280733 A1 * 11/2008 Dickie ..... A63B 22/0664 482/52
2008/0280735 A1 * 11/2008 Dickie ..... A63B 22/0664 482/62
2008/0318735 A1 * 12/2008 Smith ..... A63B 22/0007 482/52
2016/0059067 A1 * 3/2016 Miller ..... A63B 21/154 482/52
2017/0106231 A1 * 4/2017 Liao ..... A63B 22/0015
2018/0036582 A1 * 2/2018 Liao ..... A63B 22/04
2018/0200566 A1 * 7/2018 Weston ..... A63B 22/0023
2019/0001183 A1 * 1/2019 Liao ..... A63B 21/00181

* cited by examiner

ELLIPTICAL MACHINE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to an elliptical machine, and more particularly to an innovative machine that can simplify components and reduce overall volume.

2. Description of Related Art Including Information Disclosed Under 37 CFR 1.97 and 37 CFR 1.98

Modern people are often exhausted due to their busy lives when they return home. Therefore, they tend to be negligent in sports. However, after the rise of leisure and health, the concept of exercise and fitness has also risen. But, finding a suitable place for sports is another difficult problem for those who want to take part in sports. For the most popular school playground and park square, although they are convenient and free of charge, but they are not only limited in terms of suitable sports mode, and also susceptible to the influence of weather conditions, which makes it impossible to take part in sports. In view of this, there are a number of sports equipment manufacturers who have developed a variety of sports and fitness devices that are convenient for indoor use, in order to facilitate the user to be able to hold the time space, and achieve the goal of exercising and fitness at any time without going outdoors.

In the wide range of sports equipment, the trajectory of the elliptical machine pedal can simulate the trajectory of the foot and the leg in walking. Because it is more ergonomic, it is favored by many consumers. However, at the current market, the elliptical machine usually uses multiple (at least four) link mechanisms with a certain length to achieve the purpose of transmitting power, so the structure is more complicated, and of course the cost is relatively increased; furthermore, in order to smoothly link the multi-link mechanism of the elliptical machine, the elliptical machine manufacturer usually extends the length of the crank mounted on the flywheel axis to provide a larger force arm, but this will increase the volume of the housing of the flywheel, which not only increases the production cost, but also increases the transportation and storage costs due to the large volume of the package.

BRIEF SUMMARY OF THE INVENTION

The present invention mainly aims to provide an elliptical machine, and the technical problem to be solved is to have an innovative breakthrough in how to develop a new type of structure that can reduce the diameter of the flywheel.

The technical feature of the present invention is mainly that the elliptical machine includes a base and a upright column fixed on the base; a transmission mechanism mounted on the base, the transmission mechanism includes a flywheel mounted on the base by using a rotary shaft, the two ends of the rotating shaft are respectively fixed with a crank, the two cranks are located on the same diameter of the flywheel, the length of each crank is smaller than the radius of the flywheel, and the free end of each crank is fixedly connected to a pivot; the bases on both sides of the transmission mechanism are respectively provided with a link mechanism interlocking with the transmission mechanism, wherein each link mechanism includes a first link rod, a second link rod and a pedal. The first link rod is connected to the base, and the first link rod is a structural body with a telescopic function; each first link member includes a first long member and a second long member, and the first long member and the second long member are axially mounted to each other, wherein the bottom end of the first long member is pivoted on the base; the second long member is pivoted on a corresponding pivot, and is axially moved reciprocatingly relative to the first long member when the transmission mechanism is in operation, and then the rotation angle of the flywheel cyclically changes the length of a link rod; the second link rod includes a first end pivoted to the top end of the second long member; the pedal is mounted on the second link rod. When the user uses the pedal of two link mechanisms to link the transmission mechanism through the second link rod and the first link rod, the second long member is reciprocatingly moved relative to the first long member, the total length of the first link rod is reciprocatingly and continuously changed, so that the top end of the first link rod can make the circulatory movement along an elliptical path, and interlocks the second link rod, and that the pedal synchronously can make the circulatory movement along an elliptical path.

With this innovative and unique design, the present invention can reduce the overall volume of the elliptical machine by reducing the diameter of the flywheel and reduce the transportation and storage costs by using the first link rod whose cycle length is continuously changed according to the prior technology, so it has the practical progress and better industrial economy (utilization) benefits.

DETAILED DESCRIPTION OF THE INVENTION

Figure 1:
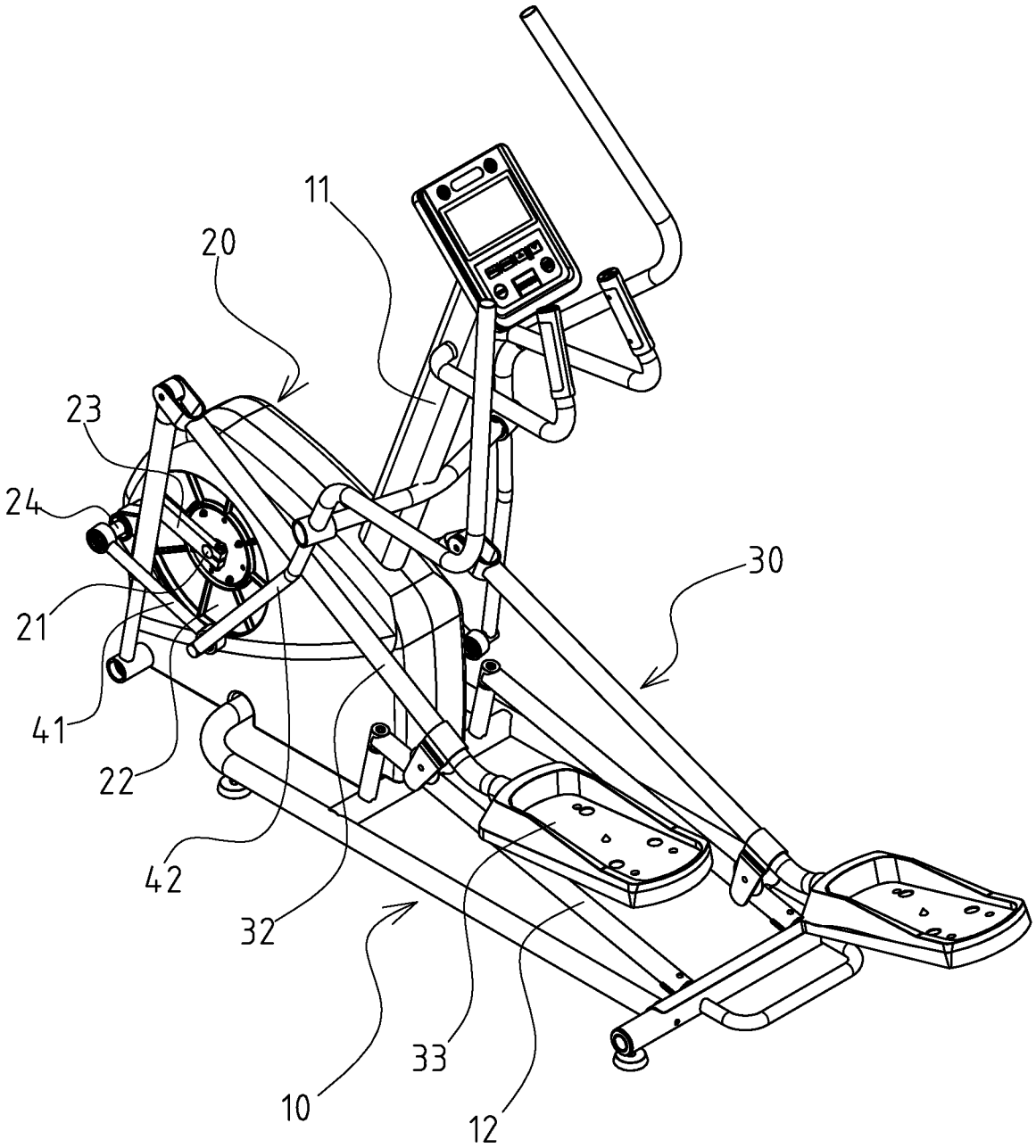
FIG. 1 is a three-dimensional outside view of the first preferred embodiment of the present invention.
Figure 2:
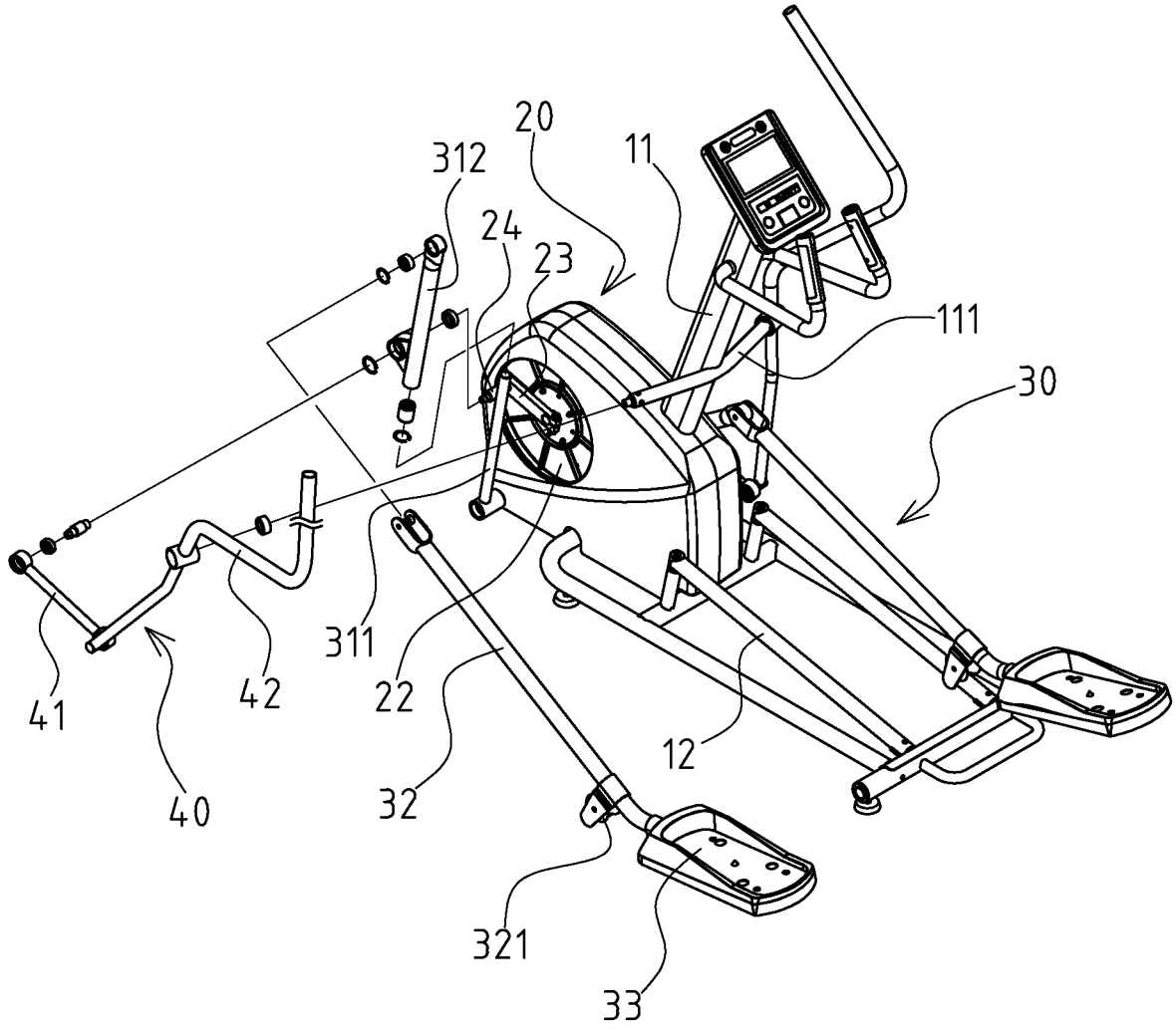
FIG. 2 is a partial three-dimensional exploded view of the first preferred embodiment of the present invention.
Figure 3:
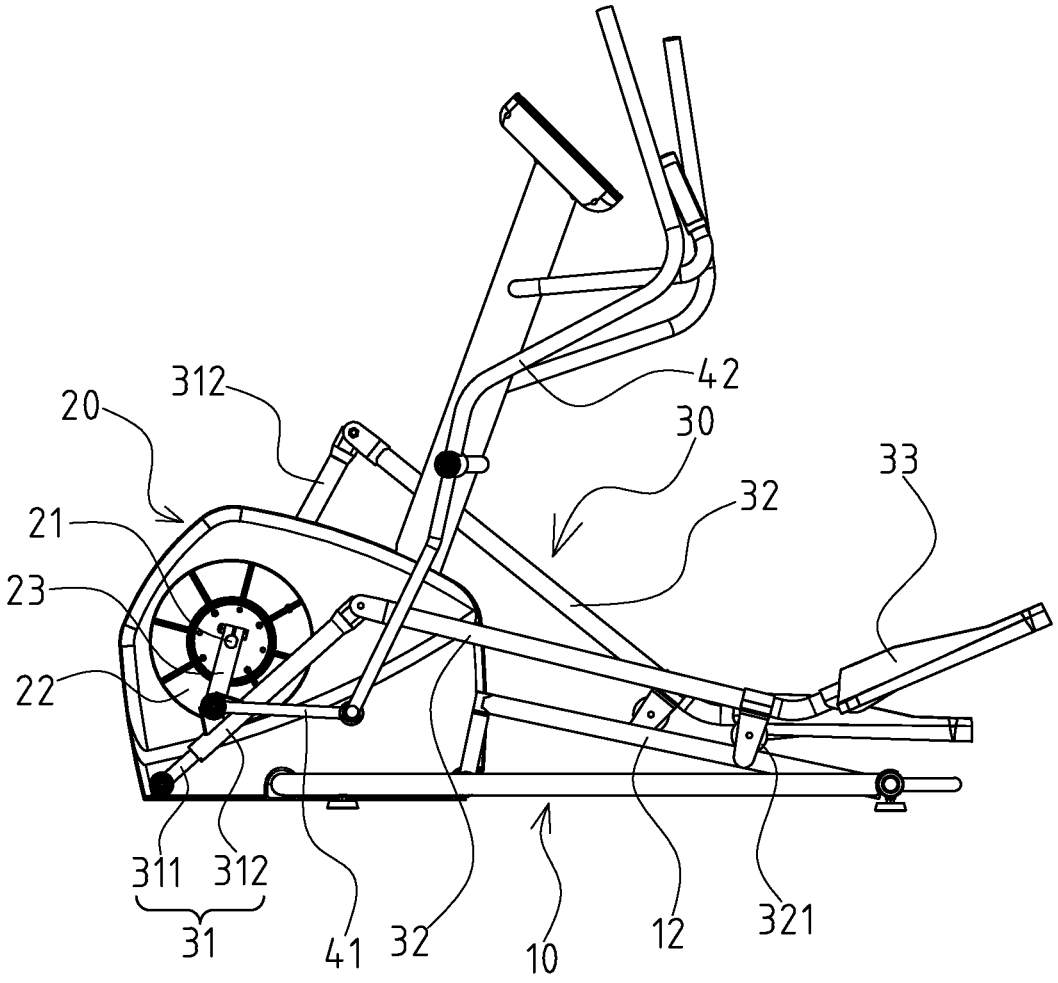
FIG. 3 is a side view of the first preferred embodiment of the first link rod with shortest length of the present invention.
Figure 4:
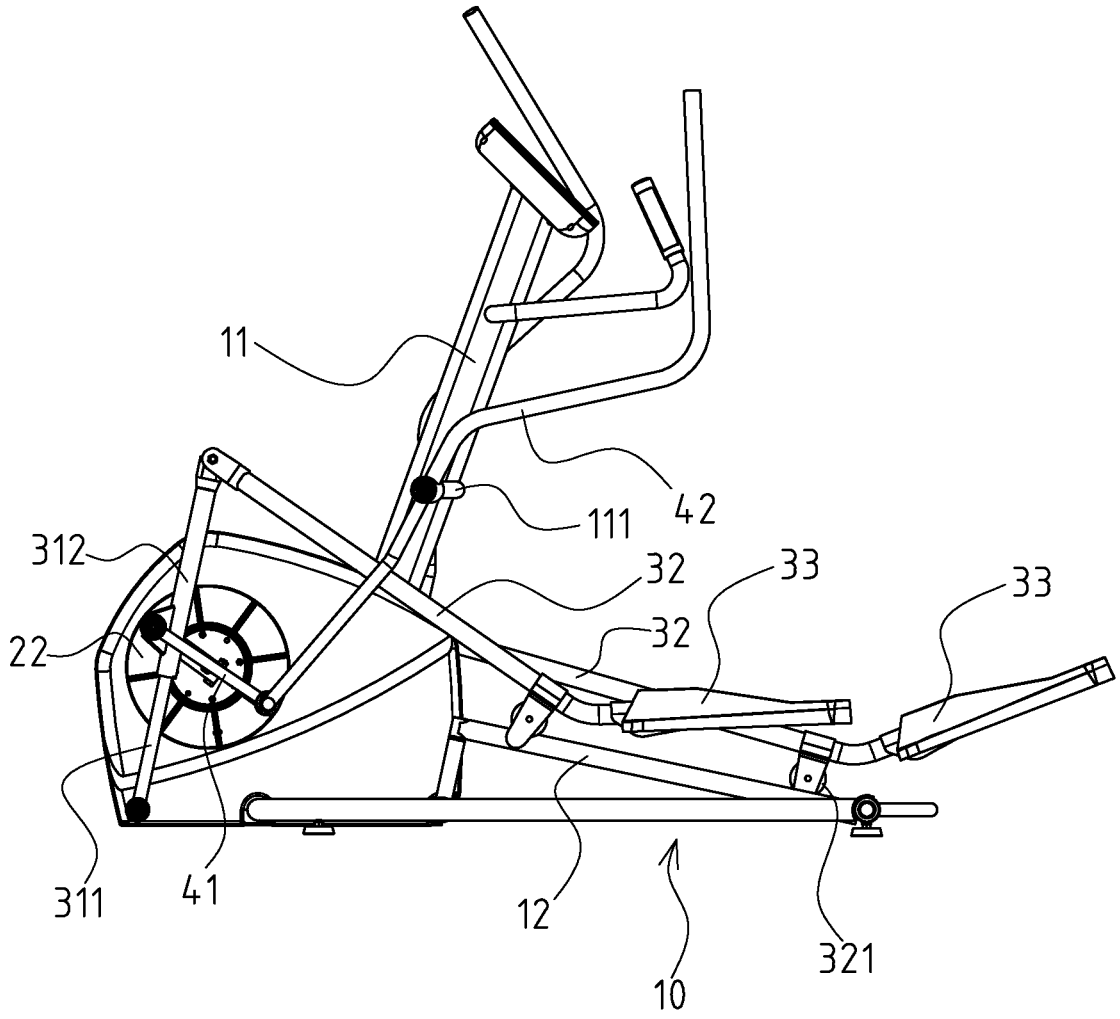
FIG. 4 is a side view of the first preferred embodiment of the first link rod with longest length of the present invention.
Figure 5:
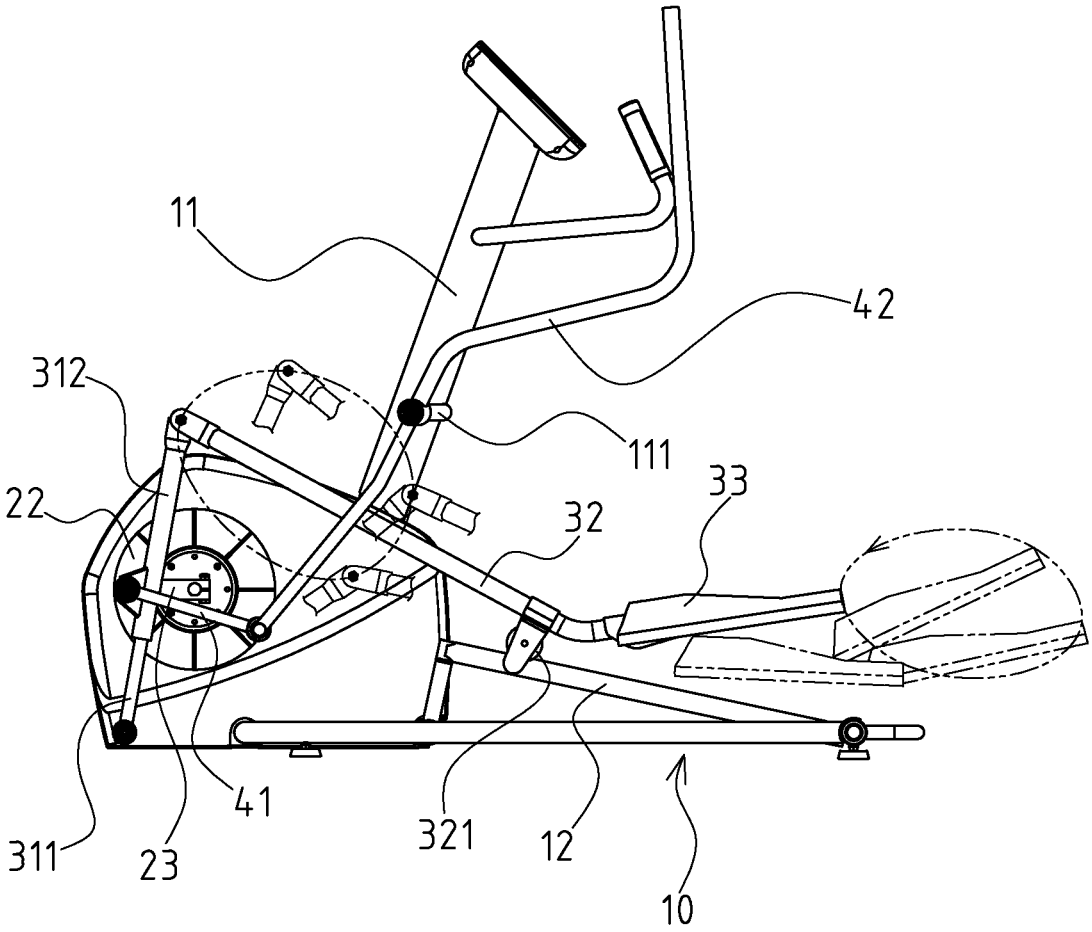
FIG. 5 is a schematic diagram of an actuation trajectory of the first preferred embodiment of the present invention.

Referring to FIGS. 1 and 2, which is the first preferred embodiment of the elliptical machine of the present invention, but these embodiments are for illustrative purposes only, and are not limited by this structure in the patent application. The first preferred embodiment of the elliptical machine mentioned in the present invention includes a base 10 and an upright column 11 fixed to the base 10; a transmission mechanism 20 mounted on the base 10, the transmission mechanism 20 includes a flywheel 22 disposed on the base 10 by a rotary shaft 21, and the two ends of the rotary shaft 21 are respectively fixed with a crank 23, the two crank 23 are located on the same diameter of the flywheel 22, the length of each crank 23 is smaller than the radius of the flywheel 22, and the free end of each crank 23 is fixed with a pivot 24; the base 10 on both sides of the transmission mechanism 20 is respectively provided with a link mechanism 30 interlocking with the transmission mechanism 20, wherein each link mechanism 30 includes a first link rod 31, a second link rod 32 and a pedal 33. The first link rod 31 is connected to the base 10, and the first link rod 31 is a structure with a telescopic function; as shown in FIG. 3, each first link rod 31 includes a first long member 311 and a second long member 312, the first long member 311 and the second long member 312 are axially mounted to each other, wherein the bottom end of the first long member 311 is pivoted on the base 10; the second long member 312 is pivoted on a corresponding pivot 24, and moves axially reciprocatingly relative to the first long member 311 when the transmission mechanism 20 is in operation, thereby the corresponding rotation angle of the flywheel 22 cyclically changes the length of the first link rod 31, as shown in FIGS. 3 and 4; the second link rod 32 includes a first end pivoted to the top end of the second long member 312; the pedal 33 is mounted on the second link rod 32. In the preferred embodiment, the pedal 33 is mounted on the second end of the second link rod 32. Referring to FIG. 5, when the user uses the pedal 33 of two link mechanisms 30 to link the transmission mechanism 20 through the second link rod 32 and the first link rod 31, the second long member 312 is axially moved reciprocatingly relative to the first long member 311, and continuously changes the total length of the first link rod 31 reciprocatingly, so that the top end of the first link rod 31 can make the circulatory movement along an elliptical path, and interlocking the second link rod 32, so that the pedal 33 synchronously can make the circulatory movement along an elliptical path.

In the first preferred embodiment, the base 10 is further provided with two track structures 12, each of which is respectively disposed at one corresponding side of the transmission mechanism 20, and the rear section of each second link rod 32 is separately disposed on one corresponding track structure 12, the pedal 33 is mounted on the second end of the second link rod 32. In the first preferred embodiment, the rear section of each second link rod 32 is provided with a roller 321, each roller 321 is rolled up and down on a corresponding track structure 12. In order to intensify the kinetic effect of the elliptical machine, the first preferred embodiment of the present invention further includes two swing arm groups 40, each of which is respectively disposed at a corresponding side of the transmission mechanism 20, and the upright column 11 is fixed with a crossbar 111; each swing arm group 40 includes a linkage rod 41 and a swing arm 42; the front end of the linkage rod 41 is pivoted on a corresponding pivot 24. The bottom end of the swing arm 42 is pivoted at the rear end of the linkage rod 41, and the middle section of the swing arm 42 is pivoted on the corresponding end of the crossbar 111. The tops of the two swing arms 42 are held by the user and swung back and forth during use.

Figure 6:
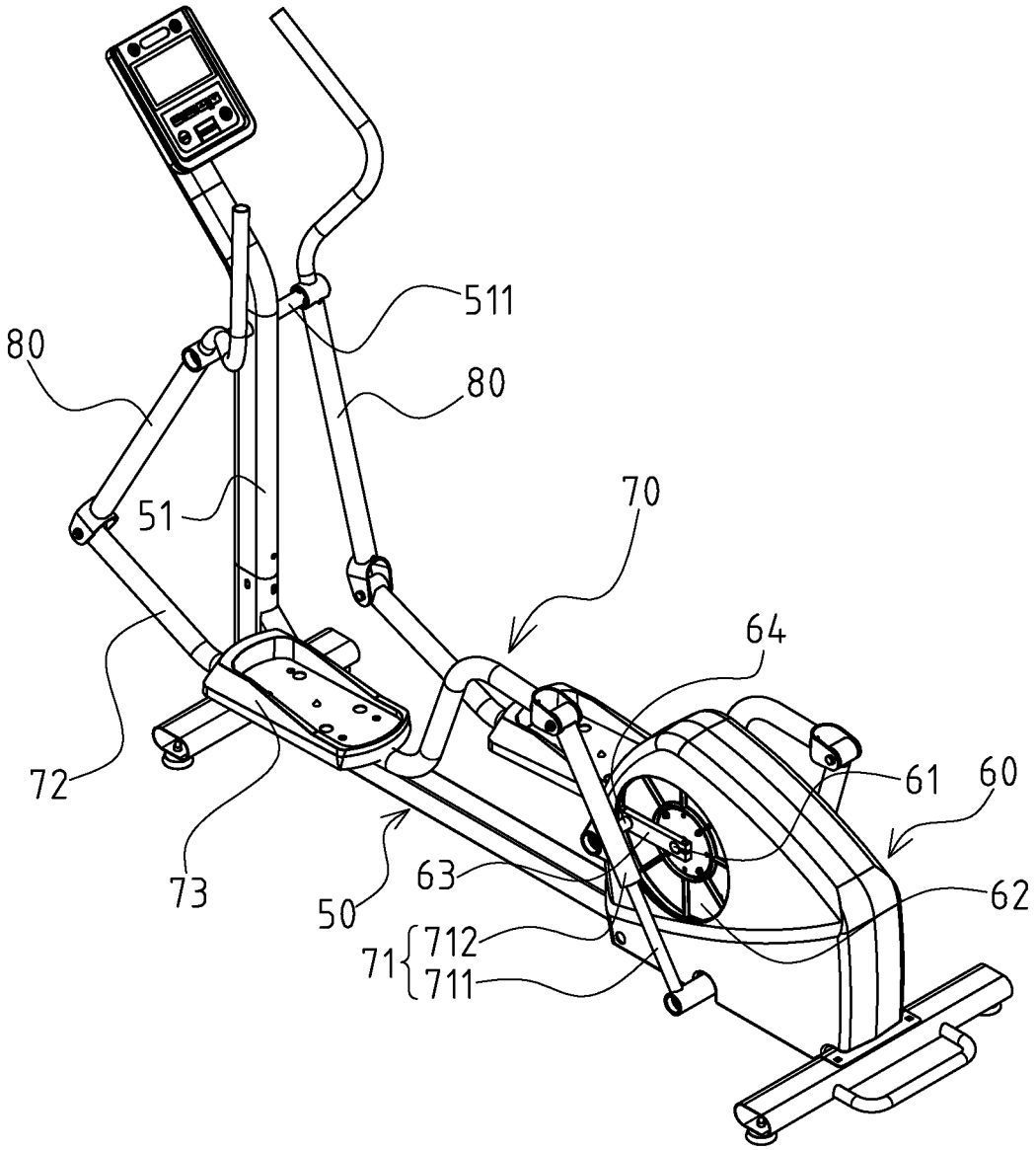
FIG. 6 is a three-dimensional outside view of the second preferred embodiment of the present invention.
Figure 7:
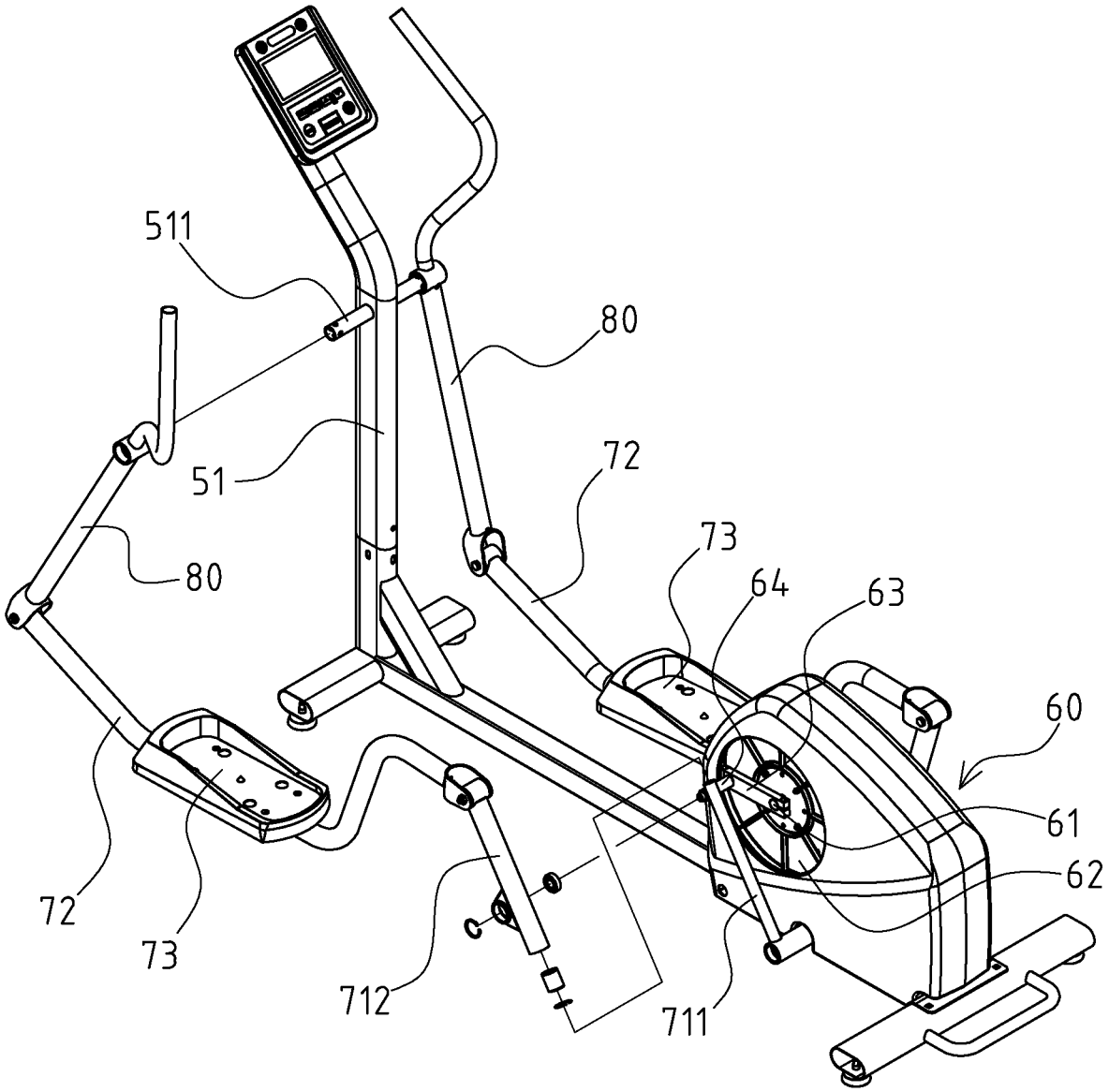
FIG. 7 is a partial three-dimensional exploded view of the second preferred embodiment of the present invention.
Figure 8:
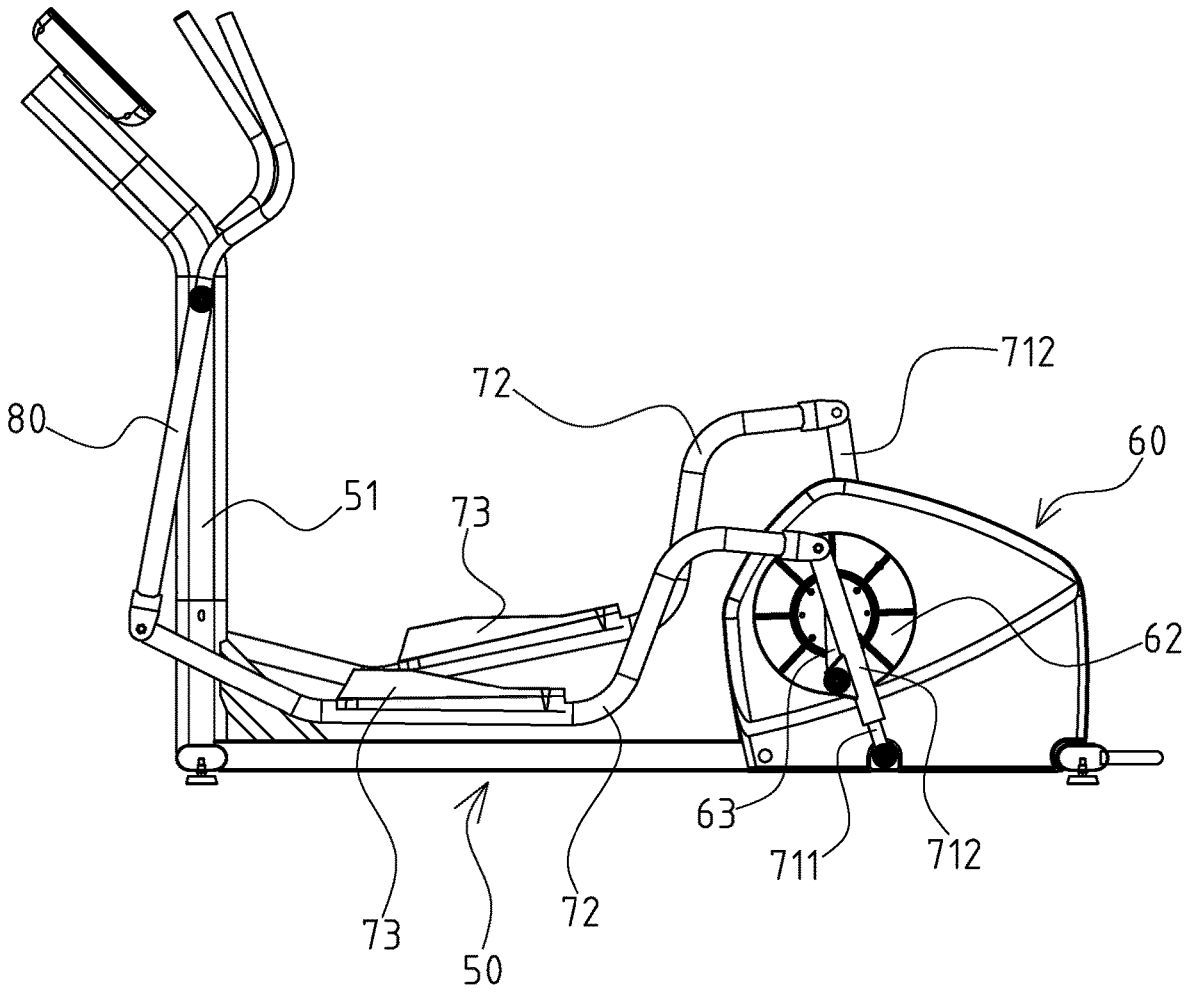
FIG. 8 is a side view of the first preferred embodiment of the second link rod with shortest length of the present invention.
Figure 9:
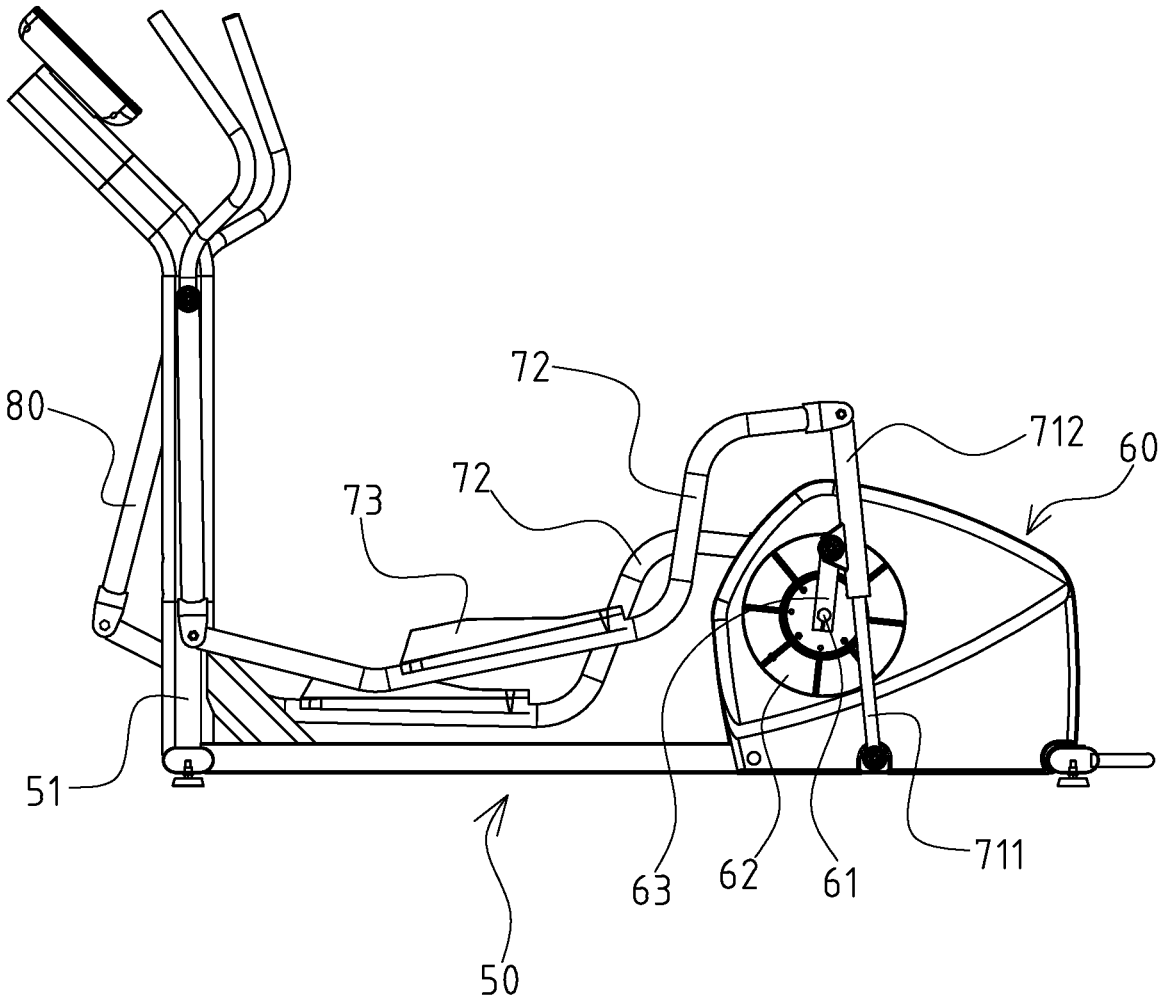
FIG. 9 is a side view of the first preferred embodiment of the second link rod with longest length of the present invention.
Figure 10:
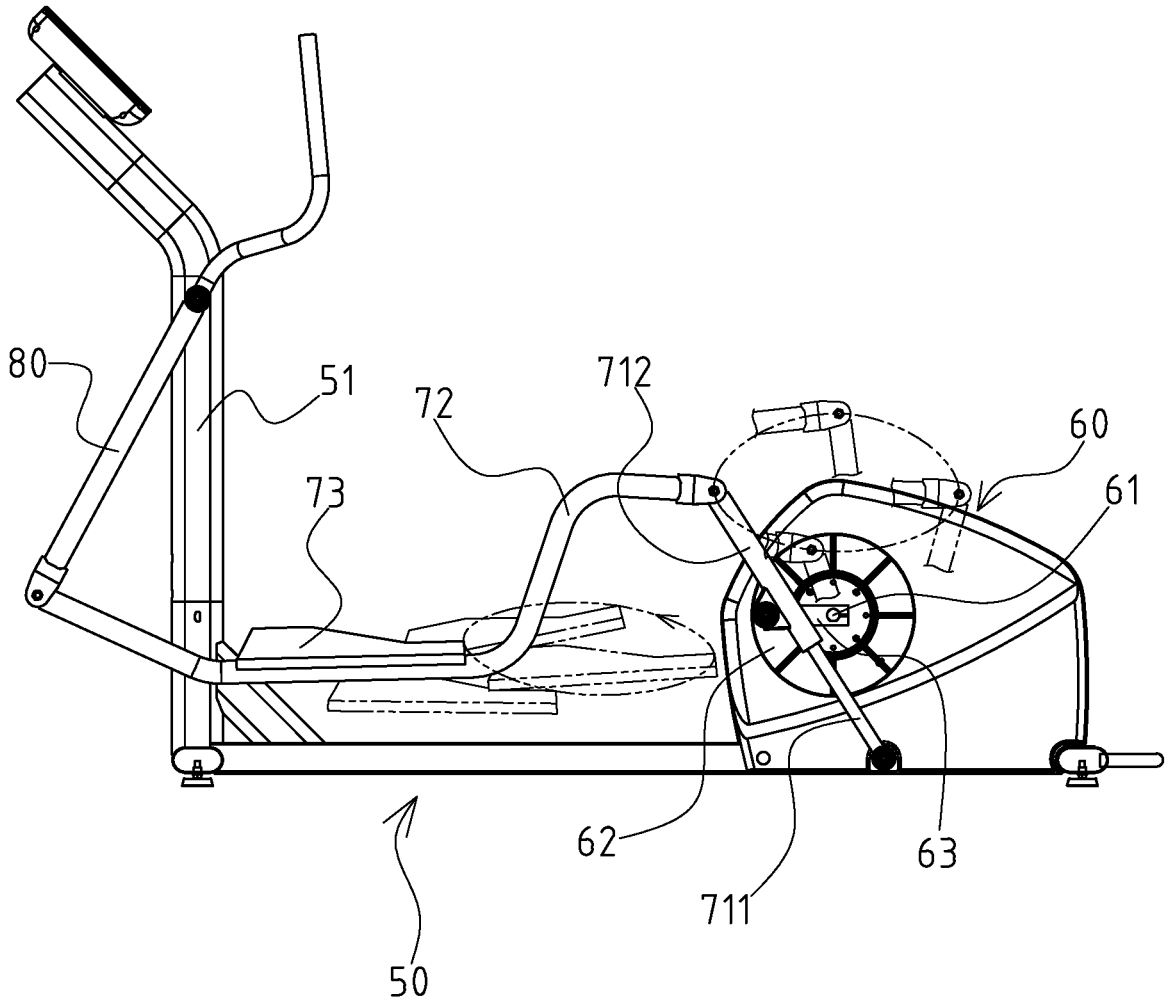
FIG. 10 is a schematic diagram of an actuation trajectory of the second preferred embodiment of the present invention.

Referring to FIGS. 6 and 7, the second preferred embodiment of the present invention includes a base 50 and an upright column 51 fixed to the base 50; a transmission mechanism 60 mounted on the base 50, the transmission mechanism 60 includes a flywheel 62 disposed on the base 50 by a rotary shaft 61. The two ends of the rotary shaft 61 are respectively fixed with a crank 63, and the two crank 63 are located on the same diameter of the flywheel 62, the length of each crank 63 is smaller than the radius of the flywheel 62, and the free end of each crank 63 is fixed with a pivot 64; the base 50 on both sides of the transmission mechanism 60 is respectively provided with a link mechanism 70 interlocked with the transmission mechanism 60, wherein each link mechanism 70 includes a first link rod 71, a second link rod 72 and a pedal 73. The first link rod 71 is connected to the base 50, and the first link rod 71 is a structure with a telescopic function; each first link member 71 includes a first long member 711 and a second long member 712. The first long member 711 and the second long member 712 are axially mounted to each other, wherein the bottom end of the first long member 711 is pivoted on the base 50; the second long member 712 is pivoted on a corresponding pivot 64, and is axially moved reciprocatingly relative to the first long member 711 when the transmission mechanism 60 is in operation, and then the rotation angle of the flywheel 62 cyclically changes the length of the first link rod 71, as shown in FIGS. 8 and 9; the second link rod 72 includes a first end pivoted on the top end of the second long member 712, and the second end of the second link rod 72 is connected to the upright column 51. Referring to FIG. 10, when the user uses pedal 73 of two link mechanisms 70 to link the transmission mechanism 60 through the second link rod 72 and the first link rod 71. The long member 712 is axially moved reciprocatingly relative to the first long member 711, the total length of the first link rod is reciprocatingly and continuously changed, so that the top end of the first link rod 71 can make the circulatory movement along an elliptical path, and interlocks the second link rod 72, and that the pedal 73 synchronously can make the circulatory movement along an elliptical path.

In order to intensify the kinetic effect of the elliptical machine, the second preferred embodiment of the present invention further includes two swing arm groups 80, each of the arm 80 is respectively disposed at a corresponding side of the transmission mechanism 60, and the upright column 51 is fixed with a crossbar 511; the bottom end of each swing arm 80 is pivoted at the second end of a corresponding link rod 72, and the middle section of each swing arm 80 is pivoted on a corresponding end of the crossbar 511. The tops of the two swing arms 80 are held by the user and swung back and forth during use.

In the above two preferred embodiments, the first long member 311/711 is a rod body, and the second long member 312/712 is a set of sleeve pipe disposed on the first long member 311/711.

We claim:

1. An elliptical machine comprising a base;

an upright column affixed to said base;

a transmission mechanism mounted on said base, said transmission mechanism having a flywheel disposed on said base by a rotary shaft, the rotary shaft having a first crank at one end and a second crank at an opposite end, each of the first and second cranks positioned in correspondence to a circumference of the flywheel, the first crank having a first pivot at a free end thereof, the second crank having a second pivot at a free end thereof; and a pair of link mechanisms each being interlocked with said transmission mechanism, each of said pair of link mechanisms being respectively installed on said base on one side of said transmission mechanism, each of said pair of link mechanisms comprising:

a first link rod connected to said base, said first link rod being telescopic, said first link rod having a first elongated member and a second elongated member that are mounted to each other along a common axis, wherein a bottom end of the first elongated member is pivotally mounted to said base, wherein the second elongated member is pivotally mounted to a corresponding pivot of the first and second pivots, the second elongated member being movable relative to the first elongated member when said transmission mechanism operates, wherein a first angle corresponding to a rotation angle of the flywheel cyclically changes a length of said first link rod;

a second link rod having a first end pivotally mounted to a top end of the second elongated member, and a pedal, wherein the pedals of said pair of link mechanisms are respectively linked to said transmission mechanism through said first link rod and said second link rod, wherein a total length of the corresponding first link rod is reciprocatingly and continuously changed when a user applies a force to said pedal such that a top end of said first link rod makes a first circulatory path along a first elliptical path and the corresponding pedal synchronously makes a second circulatory path along a second elliptical path.

2. The elliptical mechanism of claim 1, wherein said base has a pair of track structures, each of the pair of track structures installed on a corresponding side of said transmission mechanism, wherein a rear section of the second link rod being respectively disposed on one of the pair of track structures, said pedal being mounted on the second end of said second link rod.

3. The elliptical mechanism of claim 2, wherein a length of each of the first crank and the second crank is less than a radius of the flywheel.

4. The elliptical mechanism of claim 3, further comprising:

a pair of swing arm groups, wherein each of said pair of swing arm groups is respectively disposed on a corresponding side of said transmission mechanism, said upright column having a crossbar affixed thereto, wherein each of said pair of swing arm groups comprises:

a linkage rod having a front end pivotally mounted to one of the first and second pivots; and a swing arm having a bottom end pivotally mounted at a rear end of said linkage rod, wherein a middle section of said swing arm is pivotally mounted to a corresponding end of the crossbar.

5. The elliptical mechanism of claim 4, wherein the rear section of said second link rod has a roller thereon, the roller adapted to roll back-and-forth along one of said pair of track structures.

6. The elliptical mechanism of claim 1, wherein the first elongated member is a rod and the second elongated member is a sleeve pipe disposed on the first elongated member.

7. The elliptical mechanism of claim 2, wherein the first elongated member is a rod and the second elongated member is a sleeve pipe disposed on the first elongated member.

8. The elliptical mechanism of claim 3, wherein the first elongated member is a rod and the second elongated member is a sleeve pipe disposed on the first elongated member.

9. The elliptical mechanism of claim 4, wherein the first elongated member is a rod and the second elongated member is a sleeve pipe disposed on the first elongated member.

10. The elliptical mechanism of claim 5, wherein the first elongated member is a rod and the second elongated member is a sleeve pipe disposed on the first elongated member.

* * * * *